US010617226B1

(12) United States Patent
Liao

(10) Patent No.: US 10,617,226 B1
(45) Date of Patent: Apr. 14, 2020

(54) BACKREST AND SEAT OF A CHAIR

(71) Applicant: Wen Hsien Liao, Taichung (TW)

(72) Inventor: Wen Hsien Liao, Taichung (TW)

( * ) Notice: Subject to any disclaimer, the term of this patent is extended or adjusted under 35 U.S.C. 154(b) by 0 days.

(21) Appl. No.: 16/241,189

(22) Filed: Jan. 7, 2019

(51) Int. Cl.
*A47C 31/02* (2006.01)
*A47C 7/28* (2006.01)

(52) U.S. Cl.
CPC ..... *A47C 31/023* (2013.01); *A47C 7/282* (2013.01)

(58) Field of Classification Search
CPC ..... A47C 7/282; A47C 7/02; A47C 31/02; A47C 31/023; A47C 7/40
USPC ..... 297/452.56, 218.4, 218.3
See application file for complete search history.

(56) References Cited

U.S. PATENT DOCUMENTS

| | | | | |
|---|---|---|---|---|
| 6,899,398 | B2 * | 5/2005 | Coffield | A47C 7/282 297/452.56 |
| 7,152,929 | B2 * | 12/2006 | Wu | A47C 7/282 297/452.56 |
| 7,654,616 | B2 * | 2/2010 | Kinoshita | A47C 3/30 297/344.21 |
| 2007/0102987 | A1 * | 5/2007 | Chen | A47C 7/282 297/452.56 |
| 2007/0170756 | A1 * | 7/2007 | Kang | A47C 7/282 297/218.5 |

* cited by examiner

*Primary Examiner* — Milton Nelson, Jr.

(57) ABSTRACT

A supporting apparatus of a chair includes a frame, two fabrics, two liners and a cushion. The frame is formed with two grooves extending along the frame. The depth of each of the internal and external grooves is larger than the width of the same. Each of the fabrics includes a wrapper extending around a contact portion and wrapping one of the liners. The wrapper of each of the fabrics and the corresponding liner are fitted in one of the grooves so that the contact portion of the fabric is stressed. The cushion is sandwiched between the contact portions of the fabrics.

4 Claims, 5 Drawing Sheets

BACKREST AND SEAT OF A CHAIR

BACKGROUND OF INVENTION

1. Field of Invention

The present invention relates to a chair and, more particularly, to a backrest and a seat of a chair.

2. Related Prior Art

Currently, meshes are used on backrests and seats of many chairs, those used in offices in particular. Such backrest or seat includes a frame, a pressing element and screws in addition to a mesh. The frame includes a groove made in an upper, lower, front or rear side. A margin of the mesh is inserted in the groove by the pressing element. Then, the screws are inserted in the frame through the margin of the mesh and the pressing element. Thus, the margin of the mesh is firmly sandwiched between the frame and the pressing element.

Several problems have been encountered in the making of the conventional backrest or seat. Firstly, it is troublesome and takes a long period of time for the necessity to drive the screws in the frame through the mesh and the pressing element. Secondly, it requires precision to drive every screw or the screw could go in a wrong direction and go all the way through the frame or pressing element so that the tip of the screw would sticks out of the frame or pressing element and could hurt a user. In such case, the screw has to be removed from the frame or pressing element and driven in the frame or pressing element again, and this is troublesome. Thirdly, the margin of the fabric is inevitably pierced and damaged by the screws. The fabric could be torn from holes made by the screws under a considerable stress when it bears the weight of a user. Fourthly, to replace a torn fabric with a new one, the screws must be removed from the frame and the pressing element and the pressing element must be replaced with a new one. This causes lots of troubles, takes a long period of time and costs a lot of money. Fifthly, to minimize the foregoing problems, only one fabric is used in such backrest or seat. However, a single fabric is not strong enough to bear the weight of a user.

The present invention is therefore intended to obviate or at least alleviate the problems encountered in prior art.

SUMMARY OF INVENTION

It is the primary objective of the present invention to provide a chair with an easy-to-make, inexpensive and strong backrest or seat.

To achieve the foregoing objective, the backrest or seat includes a frame, two fabrics, two liners and a cushion. The frame is formed with two grooves extending along the frame. The depth of each of the internal and external grooves is larger than the width of the same. Each of the fabrics includes a wrapper extending around a contact portion and wrapping one of the liners. The wrapper of each of the fabrics and the corresponding liner are fitted in one of the grooves so that the contact portion of the fabric is stressed. The cushion is sandwiched between the contact portions of the fabrics.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
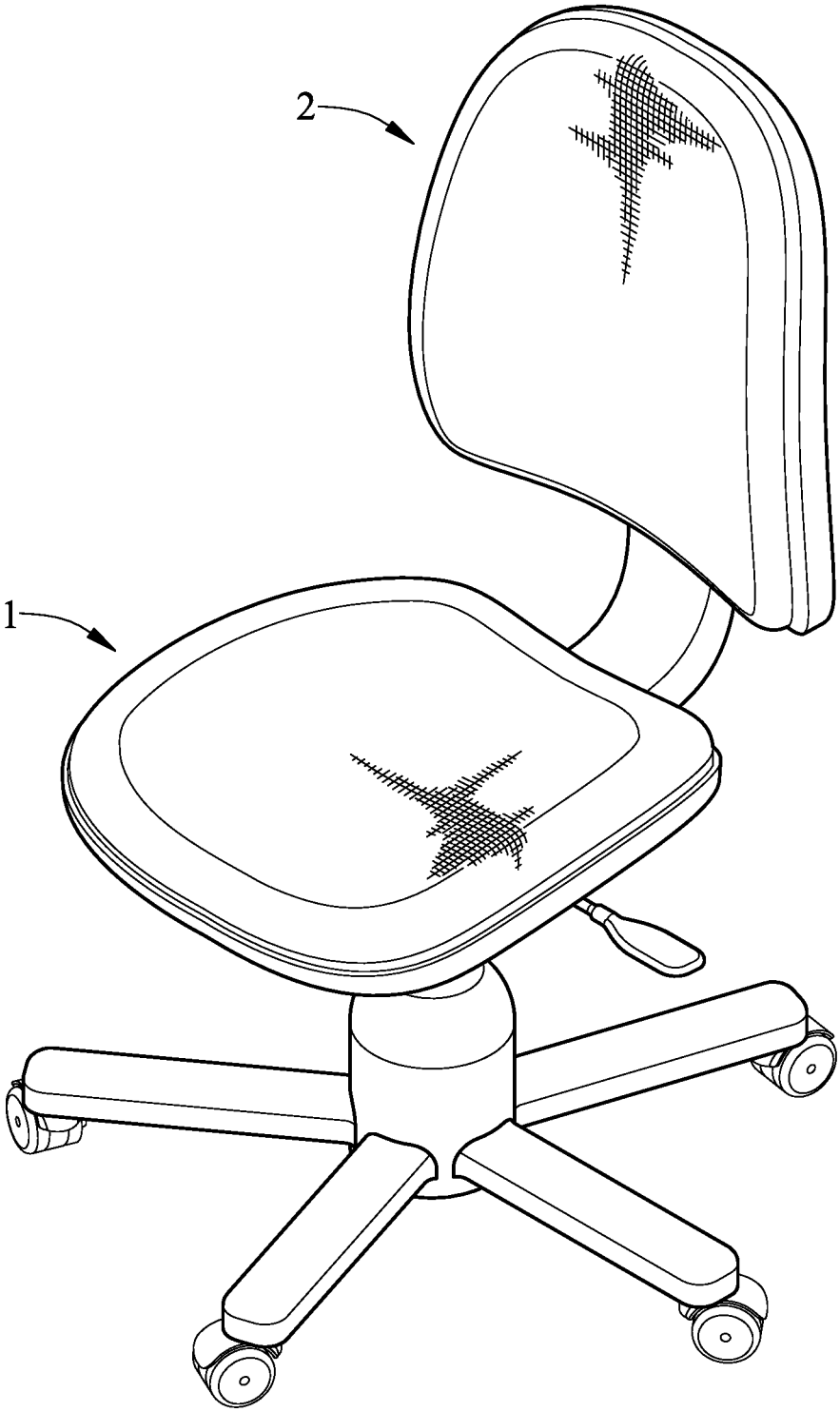
FIG. 1 is a perspective view of a chair equipped with a backrest and seat according to the preferred embodiment of the present invention.
Figure 2:
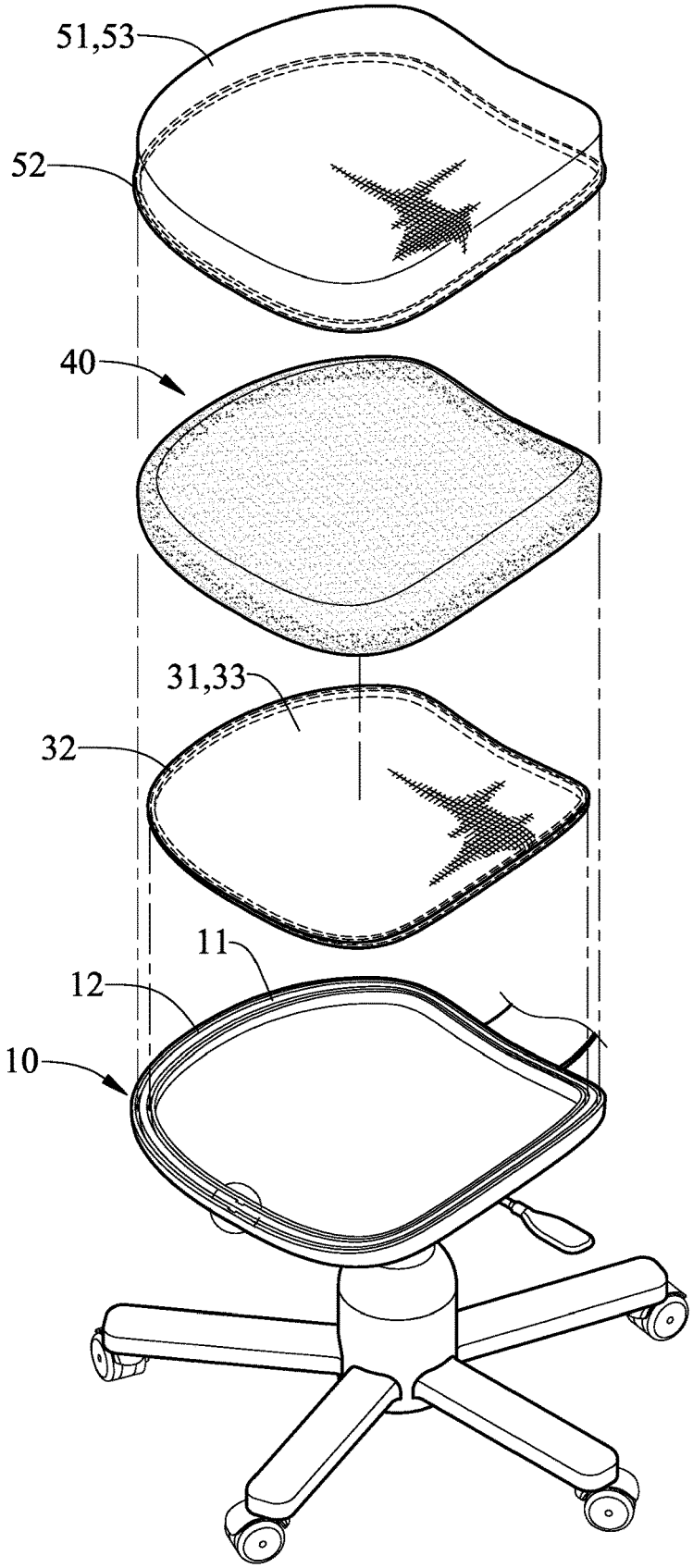
FIG. 2 is an exploded view of the seat shown in FIG. 1.
Figure 3:
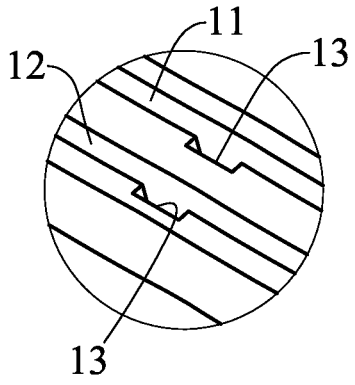
FIG. 3 is an enlarged and partial view of a frame of the seat shown in FIG. 1.
Figure 4:
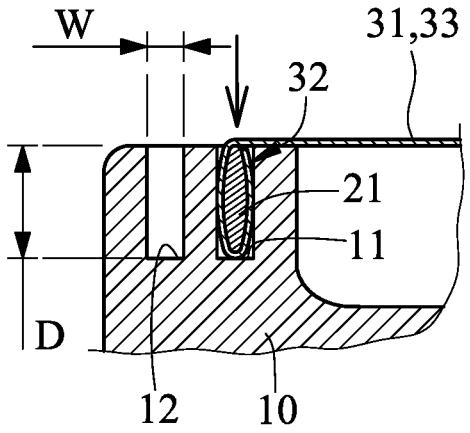
FIG. 4 is a partial and cross-sectional view of the seat shown in FIG. 1.
Figure 5:
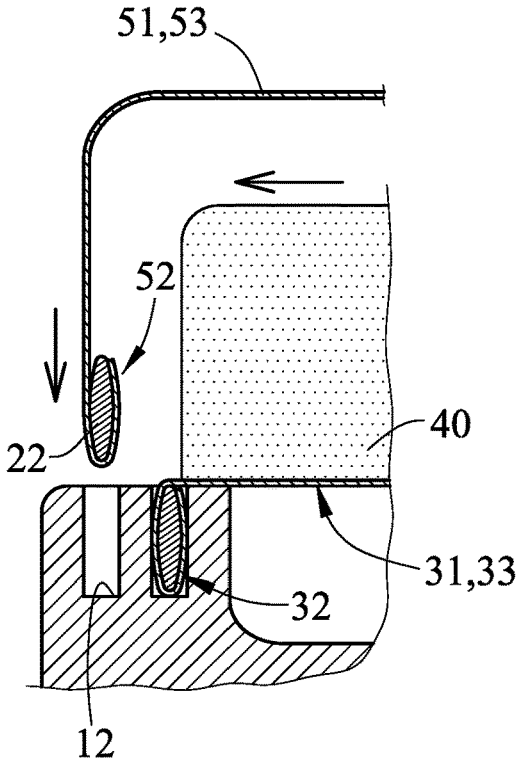
FIG. 5 is a partial and cross-sectional view of the seat in another position than shown in FIG. 4.
Figure 6:
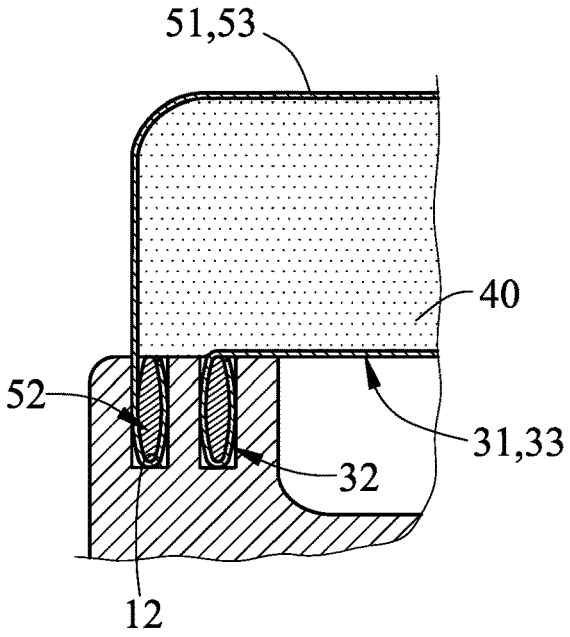
FIG. 6 is a partial and cross-sectional view of the seat in another position than shown in FIG. 5.

Referring to FIG. 1, a chair includes a seat 1 and a backrest 2 according to the preferred embodiment of the present invention. The seat 1 or the backrest 2 can be referred to as a supporting apparatus. Only the seat 1 will be described in detail for briefness and clarity.

Referring to FIG. 2 through 7, the seat 1 includes a frame 10, two liners 21 and 22, a lower fabric 31, a cushion 40 and an upper fabric 51. The frame 10 includes an internal groove 11 and an external groove 12. The internal groove 11 and the external groove 12 extend along the frame 10. Each of the grooves 11 and 12 is made with a depth D and a width W. The depth D is larger than the width W. Preferably, a ratio of the depth D over the width W is 2:1. The frame 10 further includes two cutouts 13. Each of the cutouts 13 is in communication with one of the grooves 11 and 12.

Each of the liners 21 and 22 is a strip made of a material with elastic strain, stiffness and supportiveness such as rubber.

The lower fabric 31 is preferably a mesh or any other fabric that is supportive and permeable. The lower fabric 31 includes a contact portion 33 and a wrapper 32. The contact portion 33 is in a center of the lower fabric 31. The wrapper 32 extends around the contact portion 33. The wrapper 32 is a tubular portion. A margin of the lower fabric 31 is rolled and sewed and turned into the wrapper 32.

The cushion 40 is made of foam, sponge, latex, fiber, weaving, bonded foam or another elastic material. The cushion 40 is made with thickness of 1 to 10 cm, depending on elasticity and supportiveness of the material of the cushion 40.

The upper fabric 51 is preferably a mesh that includes a contact portion 53 and a wrapper 52. The contact portion 53 is in a center of the upper fabric 51. The wrapper 52 extends around the contact portion 53. The wrapper 52 is a tubular portion. A margin of the upper fabric 51 is rolled and sewed and turned into the wrapper 52.

The first liner 21 is inserted in the wrapper 32 before the margin of the lower fabric 31 is rolled and sewed and turned into the wrapper 32. The second liner 22 is inserted in the wrapper 52 before the margin of the upper fabric 51 is rolled and sewed and turned into the wrapper 52.

The wrapper 32, which contains the first liner 21, is fitted in the internal groove 11. Thus, the lower fabric 31 is connected to and kept on the frame 10. The contact portion 33 is stressed and ready to contact and support a user.

Then, the cushion 40 is supported on the contact portion 33 of the lower fabric 31.

Then, the wrapper 52, which contains the second liner 22, is fitted in the external groove 12. Thus, the upper fabric 51 is connected to and kept on the frame 10. The contact portion 53 of the upper fabric 51 is stressed and ready to support a user. Thus, the cushion 40 is kept between the contact portion 53 of the upper fabric 51 and the contact portion 33 of the lower fabric 31.

Figure 7:
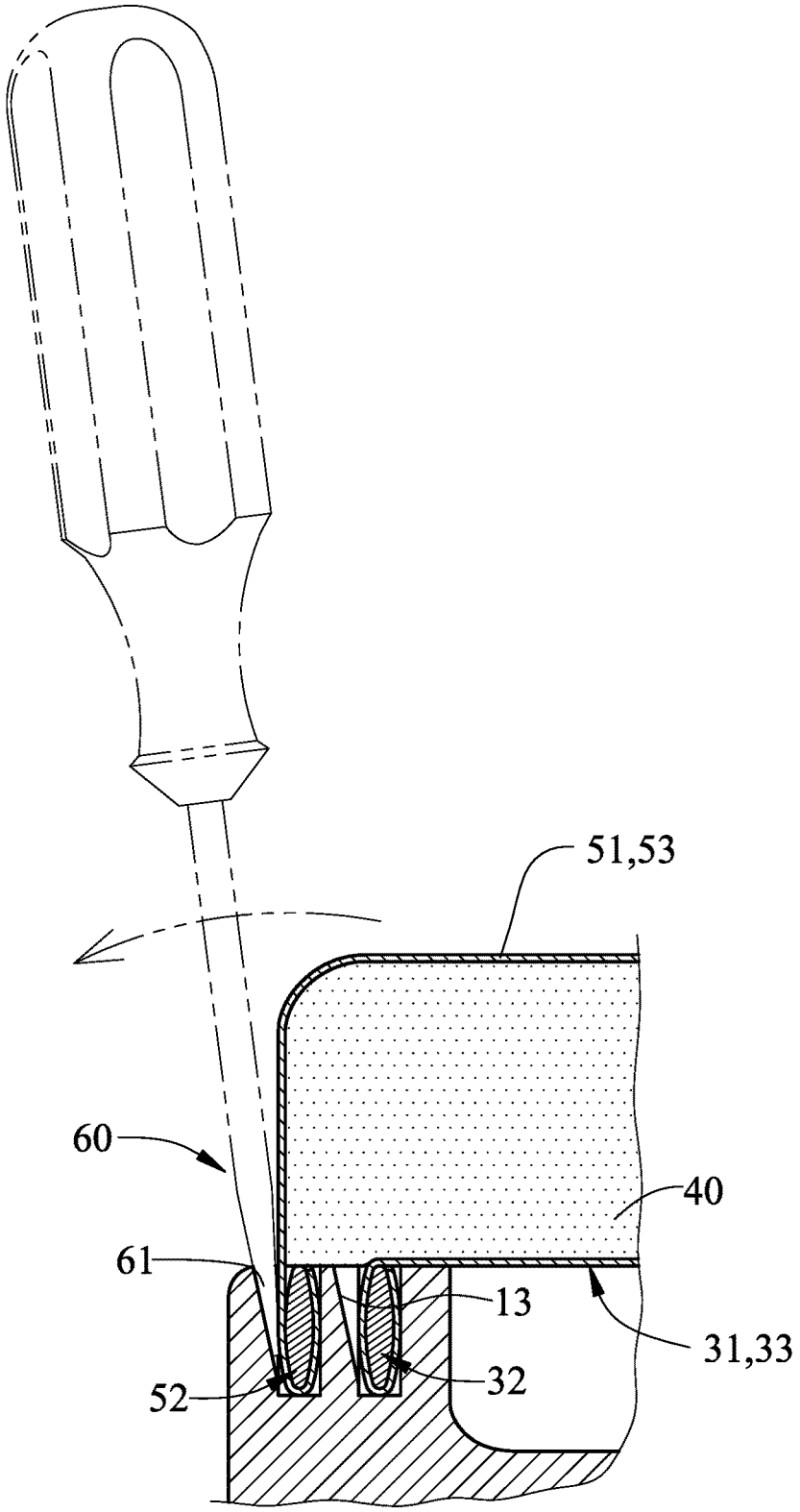
FIG. 7 is a partial and cross-sectional view of the seat in another position than shown in FIG. 6.

Referring to FIG. 7, a hand tool 60 such as a screwdriver can be used to take the lower fabric 31 and the upper fabric 51 from the frame 10. The hand tool 60 is pivoted after a flat end 61 thereof is inserted in one of the cutouts 13. Thus, a portion of the wrapper 32 or 52 is removed from the internal groove 11 or the external groove 12. Then, a user can move the upper fabric 31 or the upper fabric 51 completely out of the internal groove 11 or the external groove 12. Now, the lower fabric 31 or the upper fabric 51 can be replaced with a new one.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A chair comprising a supporting apparatus comprising:

a frame (10) formed with an internal groove (11) and an external groove (12), wherein the internal and external grooves (11, 12) extend along the frame (10), wherein each of the internal and external grooves (11, 12) is made with depth (D) and width (W) smaller than the depth (D);

a first liner (21);

a lower fabric (31) comprising a contact portion (33) and a wrapper (32) extending around the contact portion (33) and wrapping the first liner (21), wherein the wrapper (32) of the lower fabric (31) and the first liner (21) are fitted in the internal groove (11) so that the contact portion (33) of the lower fabric (31) is stressed;

a cushion (40) supported on the contact portion (33) of the lower fabric (31);

a second liner (22);

an upper fabric (51) comprising a contact portion (53) and a wrapper (52) extending around the contact portion (53) of the upper fabric (51) and wrapping the second liner (22), wherein the wrapper (52) of the upper fabric (51) and the second liner (22) are fitted in the external groove (12) so that the contact portion (53) of the upper fabric (51) is stressed, wherein the cushion is kept between the contact portion (53) of the upper fabric and the contact portion (33) of the lower fabric (51).

2. The chair according to claim 1, wherein a ratio of the depth over the width is 2:1.

3. The chair according to claim 1, wherein the frame (10) further comprises two cutouts (13) each of which is in communication with one of the internal and external grooves (11, 12).

4. The chair according to claim 1, wherein the cushion (40) is made with thickness of 1 to 10 cm.

* * * * *